US006247190B1

(12) United States Patent
Rigopoulus

(10) Patent No.: US 6,247,190 B1
(45) Date of Patent: Jun. 19, 2001

(54) PLUNGER APPARATUS WITH CONTROLLABLE VENTILATION

(76) Inventor: Christopher T. Rigopoulus, 30 Gold Run Pl., Stockton, CA (US) 95207

( * ) Notice: Subject to any disclaimer, the term of this patent is extended or adjusted under 35 U.S.C. 154(b) by 0 days.

(21) Appl. No.: 09/433,561

(22) Filed: Nov. 4, 1999

(51) Int. Cl.[7] ..... E03D 11/00
(52) U.S. Cl. ..... 4/255.12
(58) Field of Search ..... 4/255.04, 255.05, 4/255.06, 255.09, 255.11, 255.12

(56) References Cited

U.S. PATENT DOCUMENTS 1,734,206 * 11/1929 Fisch ..... 4/255.05
3,336,604 * 8/1967 Lacey et al. ..... 4/255.11
4,768,237 * 9/1988 Torti ..... 4/255.12 X

* cited by examiner

*Primary Examiner*—Charles E. Phillips
(74) *Attorney, Agent, or Firm*—Alfred F. Hoyte, Jr.

(57) ABSTRACT

A plunger assembly having a plunger portion and an elongated handle with a central bore. The plunger portion has a bottom opening sized for fluid communication with a drain opening. The top end of the plunger portion has a threaded opening sized to receive the threaded end of the elongated handle, and allowing for fluid communication with the central bore. A check valve assembly rests on an annular seat formed inside the bottom of the elongated handle proximate the opening formed in the top end of the plunger portion. The check valve serves to allow airflow into the top end of the plunger portion while preventing airflow out of the top end of the plunger portion to prevent undesired backflow. Further regulation of the air flow into the plunger portion is achieved by providing a cap, at the top of the elongated handle for selectively allowing airflow into and through the central bore. The cap, in cooperation with a rubber gasket, allows for variable control of the amount of air which can enter the central bore and therefore the plunger portion. An adapter element may be used to allow connection of the handle to a conventionally sized threaded plunger portion. A portable carrying case provides a sanitary enclosure which allows for movement of the plunger between rooms with contaminating other rooms with potentially hazardous biological waste and debris.

2 Claims, 2 Drawing Sheets

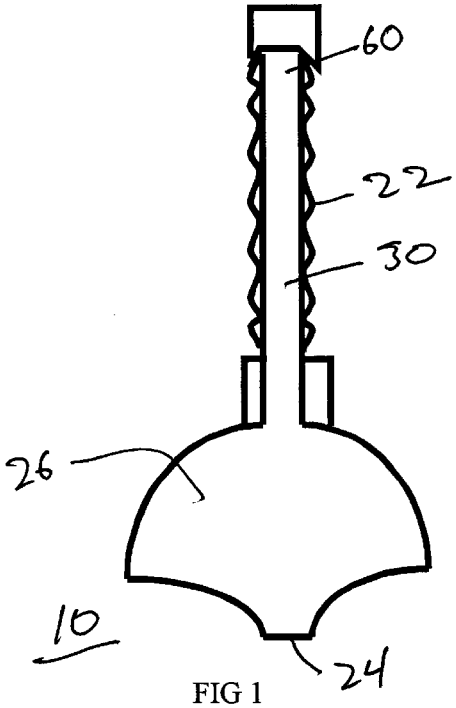
FIG 1
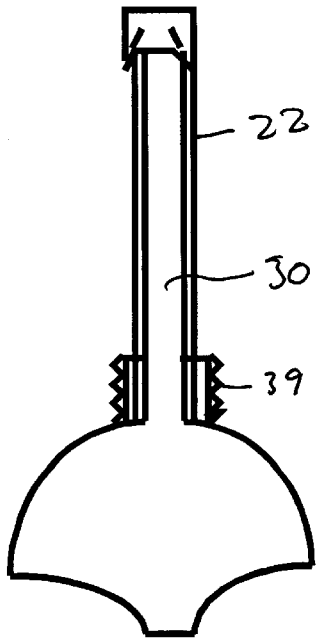
FIG 2
FIG. 3A FIG. 3B FIG. 3C
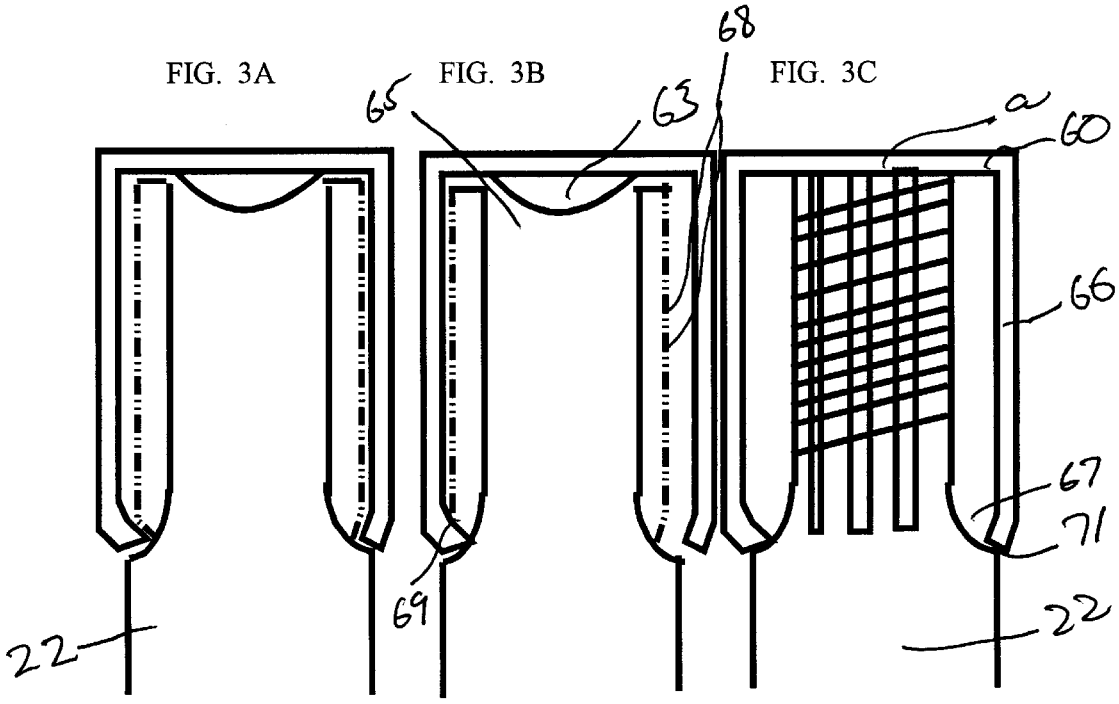

PLUNGER APPARATUS WITH CONTROLLABLE VENTILATION

BACKGROUND OF THE INVENTION

The present invention relates to a plunger apparatus. More particularly, it relates to an improved plunger apparatus with a one way valve that prevents unintended removal of sludge and waste from a drainage line.

STATEMENT OF THE PRIOR ART

Various types of apparatus for clearing clogged drains are known in the plumbing art. One of the most common of these is a plunger. Typical plungers have a smooth walled, flexible, bell shaped plunger portion with an elongated handle attached thereto which allows the user to position the opening of the plunger portion over the drain. With the opening of the plunger portion positioned over the drain opening and in fluid communication with the drain pipe, the user may thrust downward forcing the plunger portion to collapse which in turn forces air down into the drainpipe with sufficient force to eventually push the "clog" down and clear the drain. The problem with these plungers is that when the handle is released and the plunger portion is allowed to expand, the resulting vacuum tends to pull the "clog" up, in effect creating a backflow that may carry other debris along with it, thus reducing the overall effectiveness of the plunger and exposing the user and the environment to potentially hazardous biological waste.

Several attempts have been made to alleviate this problem. U.S. Pat. No. 4,566,139 issued to Jeng discloses a plunger having a piston element. A vent, which is in fluid communication with the hollow handle allows air to be pulled in through the handle into the suction cup to prevent backflow. The drawback with this mechanism is that it has a complicated assembly, including the piston, which may become stuck with extended use. Also, the unconventional shape of the suction cup, along with the relatively large diameter of the handle do not allow for retrofit with conventional plunger components.

U.S. Pat. No. 4,745,641 issued to Tash discloses another ventilated plunger assembly. The assembly is adapted specifically for plunging toilet bowls and includes a bellows type plunger portion. The handle has a central bore that is in fluid communication with the plunger portion. An aperture at the top end of the handle may be selectively opened to allow for the flow of air therethrough and into the plunger portion. The drawback with this assembly is that there is no mechanism for preventing air from entering the central bore when the user engages in the downward thrust motion. Some air contained in the collapsible plunger element is forced into the drain, but a small amount is forced into the central bore, thus reducing the effectiveness of the plunger element. Also, the extent to which air is allowed to enter the aperture at the top of the handle is not variable and thus the user cannot choose an opening that is particularly effective for a given application. Finally, contaminants may enter the central bore and collect therein.

None of the above inventions and patents, taken either singly or in combination, is seen to describe the instant invention as claimed.

SUMMARY OF THE INVENTION

The present invention overcomes the disadvantages of the prior art by providing a plunger assembly that has a plunger portion and an elongated handle having a central bore. The plunger portion has a bottom opening sized for fluid communication with a drain opening. The top end of the plunger portion has a threaded opening sized to receive the threaded end of the elongated handle, and allowing for fluid communication with the central bore. A check valve assembly rests on an annular seat formed inside the bottom of the elongated handle proximate the opening formed in the top end of the plunger portion. The check valve serves to allow airflow into the top end of the plunger portion while preventing airflow out of the top end of the plunger portion to prevent undesired backflow. Providing a cap achieves further regulation of the air flow into the plunger portion at the top of the elongated handle for selectively allowing airflow into and through the central bore. The cap, in cooperation with a sealing means, allows for variable control of how much air that can enter the central bore and therefore the plunger portion. An adapter element may be used to allow connection of the handle to a conventionally sized threaded plunger portion. A portable carrying case provides a sanitary enclosure which allows for movement of the plunger between rooms without contaminating other rooms with potentially hazardous biological waste and debris.

Accordingly, it is a principal object of the invention to provide a new and improved plunger.

Accordingly, it is an object of the invention to provide a new and improved plunger which has means to prevent the occurrence of backflow.

It is another object of the invention to provide a new and improved plunger having a hollow elongated handle in fluid communication with the plunger portion.

It is another object of the invention to provide a new and improved plunger having a check valve positioned between the plunger portion and the hollow elongated handle to prevent backflow into the hollow elongated handle.

It is another object of the invention to provide a new and improved plunger having an adjustable air valve positioned at the top of the elongated handle to allow for selectively adjusting the amount of airflow into the handle.

It is another object of the invention to provide a new and improved elongated handle for a plunger which may be retrofit with a conventional plunger portion or suction cup.

It is another object of the invention to provide a new and improved plunger apparatus which includes a sanitary carrying case.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 1 shows a partially broken away plan view of the plunger of the present invention.

FIG. 2 shows an exploded plan view, partly in section, of the plunger of the present invention.

FIG. 3(*a*) shows a side cross sectional view of the cap for the elongated handle of the plunger.

FIG. 3(*b*) shows a side cross sectional view of the cap for the elongated handle of the plunger with the cap depressed.

FIG. 3(*c*) shows a side view of the cap for the elongated handle.

DETAILED DESCRIPTION

Figure 5:
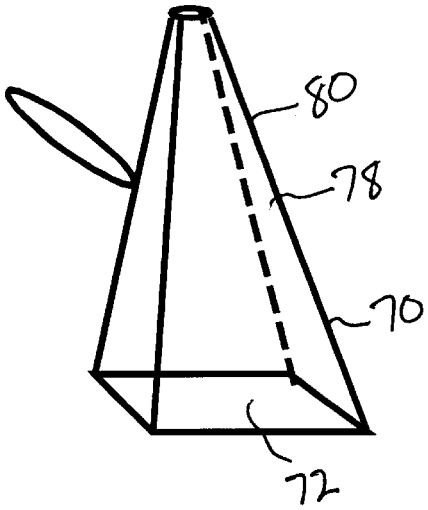
FIG. 5 shows a sectional view of a carrying case for the plunger.
Figure 6:
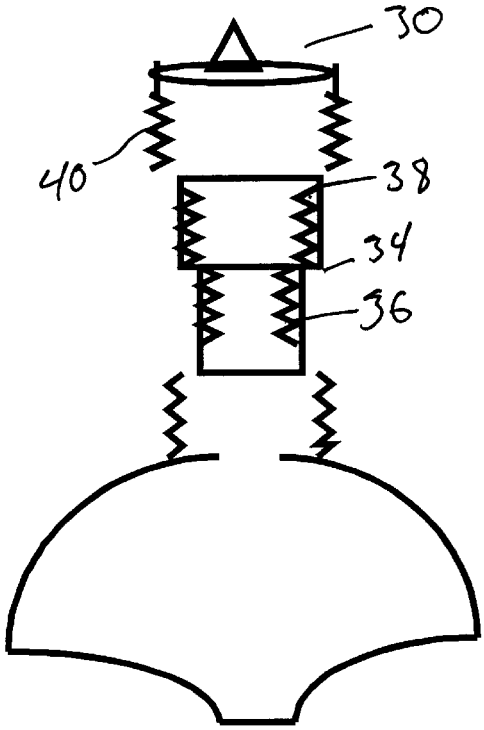
FIG. 6 shows an adapter which allow connection of the elongated handle to a conventional plunger portion.

Referring now to FIGS. 1–7, a plunger apparatus and carrying/storage case formed in accordance with the present invention, generally indicated by the numeral 10, is shown.

The plunger 10 includes a bell shaped plunger portion 20 and an elongated handle 22. The plunger portion 20, which is preferably formed from a flexible material such as rubber, has a bottom opening 24 adapted to be seated over a drain opening (not shown) in sealing engagement therewith so that air may be forced from the interior cavity 26 of the plunger portion 20 into the drain pipe (not shown) in order to effect clearing thereof. In accordance with one aspect of the invention, the plunger portion 20 may be of a conventional type, including a threaded top opening 28 sized for threaded engagement with the bottom end of a conventional elongated handle.

The elongated handle 22 of the present invention is hollow or has a central bore 30. The central bore 30 should have sufficient diameter to allow unrestricted airflow therethrough. Therefore, preferably the elongated handle 22 has a somewhat large diameter than a conventional handle. Also, the elongated handle 22 is preferably contoured as shown in FIG. 1 to provide increased grip. The bottom end 32 of the elongated handle 22 is preferably threaded to allow for threaded engagement with the opening 28 in the plunger portion. If it is desired to use a conventional plunger portion (not shown) with the elongated handle, the relatively small opening of the conventional plunger portion must be accommodated. To that end, an adapter 34 may be provided with the apparatus of the present invention as may be seen more clearly in FIG. 6. The adapter 34 is a hollow cylindrical connector having a small diameter portion 36 and a large diameter portion 38 which are axially aligned. Both portions 36, 38 are threaded for connection to the opening in the top of the conventional plunger portion and the elongated handle 22 of the present invention, respectively. It should be noted here that a flange 39 is provided at the bottom end of the elongated handle 22 to prevent slippage of the bottom end of the elongated handle into the plunger portion 20 during vigorous plunging.

Also at the bottom end of the elongated handle 22 and interiorly disposed is a check valve assembly 40. The assembly 40 is essentially a standard assembly sized to fit within the bore 30 of the elongated handle 22. The check valve assembly 40 has two components. A disk 42 having a central bore 44 and some centrally positioned vents 46 as is well known in the art is the first component. The second component, commonly known as a check 50, is also disk shaped and has a flat surface and a convex surface, with a centrally positioned protuberance 51 aligned with the central bore of the first component. Air flow into the handle 22 is prevented since upward air pressure will push the check 50 flush against disk 42 thereby sealing both the central bore 44 and the vents 46. The top portion 52 of the protuberance retains the check 50 when downward air flow is pushed through bore 44 and vents 46. The check valve 40 may be positioned upon an annular seat 54 which may be either glued in place or an integral part of the elongated handle 22.

Referring particularly to FIGS. 3(*a*)–3(*c*) the top end 56 of the elongated handle 22 has a plurality of grooves 59 formed therein which allows air to enter and flow through an airgap 61 existing between the cap 60 and the top end 56 of the elongated handle 22, the airgap 61 only existing when the cap 60 is not depressed as shown in FIG. 3(*a*). As can be seen in FIG. 3(*b*) cap 60 may be pushed down to prevent airflow through the grooves 59, with protruding nipple 63 serving to provide a seal against air flow when compressed by pressure placed upon the cap 60. The nipple 63 is sized to come into sealing engagement with the opening 65 formed in the top end 56 of the elongated handle 22. The fingers 66 of the cap 60 have projections 67 protruding from their bottom ends which engage the threads 68 formed on the exterior surface of the top end 56 thus allowing for engagement of the cap 60 with the top end 56. Rotation of the cap 60 with the projections 67 engaged within the threads 68 allows the cap 60 to be secured about the top end 56 of the elongated handle 22 in the position as shown in FIGS. 3(*a*) and 3(*c*). When the cap 60 is seated as shown in FIGS. 3(*a*) and 3(*c*) air may enter the opening 65 and central bore 42 of elongated handle 22 through grooves 59 and spaces between fingers 66 as indicated by lead lines a. Application of about 2 lbs of pressure on the top of cap 60 causes sealing engagement of nipple 63 with the opening 56, the bottom ends of fingers 66 spreading radially as projections 67 slide out of engagement with the annular groove 69 formed in the top end 56. The groove has tapered sidewalls 71 to allow for a gradual radial expansion of the bottom ends of the fingers 66, the shape of the projections 67, in combination with the shape of the tapered sidewalls 71 serving to urge the cap 60 upward thus disengaging nipple 63 from opening 56 when no downward pressure is applied to the cap 60. It can be appreciated that a fairly robust, resilient plastic material must be used for the fingers in order to prevent permanent deformation thereof after repeated use.

As is often the case, a plunger must be carried from one location to another within the home or business in order to service more than one drain. This task often creates a biological hazard since biological waste may have been sucked into the plunger portion. Although the plunger portion is typically rinsed after use, even a thorough rinsing will not remove all bacteria and other contaminants. Indeed, the wet plunger portion is more likely to drip contaminants while being carried from one room to the next. This can be a serious problem when small infants are in the home. To that end, the present invention has a carrying case 70 designed to contain the apparatus 10. The case 70 has a relatively rigid base 72 with a plurality of support members 74 extending therefrom. The base 72 has legs 76 extending downwardly therefrom to reduce the amount of surface area of the base 72 in contact with the floor. This helps to reduce the amount of bacteria which can collect under the base 72. It should be noted that waste which is collected onto the plunger portion 20 may come into contact with the case 70 when the plunger portion 20 is being placed inside the case and thus an opportunity exists for bacteria to collect under the base 72. A fabric covering 78 may be placed over the support members 74 to form an enclosure. The fabric is preferably a washable fabric which may be sanitized in hot water and detergent. The covering 78 also has a plurality of ventilation holes 80 which allow for quicker drying of the plunger portion 20 and handle 22. A carrying strap 82 is provided at the top end of the case 70 so that the user's hands do not have to come into contact with any portion of the plunger handle 22, plunger portion 20, or fabric covering 78.

Figure 7:
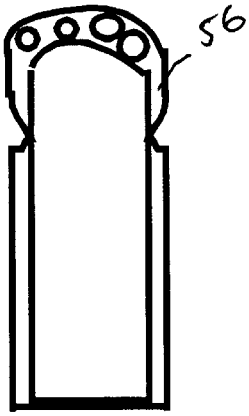
FIG. 7 shows an alternative cap for attachment to the top end of the elongated handle.
Figure 7:
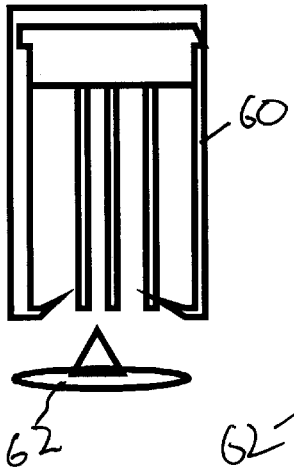
Figure 4:
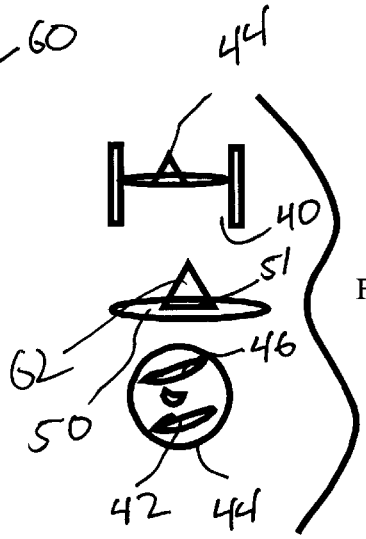
FIG. 4 shows a side view of a check valve for the elongated handle.

FIG. 7 shows an alternative embodiment for cap 60. An annular recess 57 is formed at the top of the cap and sized to contain washer 62 therein. The recess 57 sidewalls have a height about twice the thickness of the washer 62 so that the cap must be depressed in order to force the washer into sealing engagement with the notches 59 thus preventing airflow through the cap 60.

In operation, the user positions the bottom end 24 of the plunger portion 20 over the drain opening. The user then thrusts downward in the conventional manner using elongated handle 22 to apply sufficient pressure upon the plunger portion 20 to cause it to collapse sending a high velocity air packet into the drain. Air is prevented from entering the bore 30 of the elongated handle 22 by check valve 40. When the elongated handle 22 is released, the plunger portion 20 begins to expand, with makeup air flowing through the top end 56 via grooves 59 in the top end 56 of the handle 22 and cap 60. If it is desired to allow some suction of the drain line, then the vents may be occluded by pressing down on the cap 60 thereby compressing nipple 63 into sealing engagement with the opening 65 in the top end of the handle 22 preventing make up air from entering the plunger portion. The amount of pressure on the cap 60 may be varied thereby allowing adjustment of the amount of suction. When the user has finished the plunging operation, he may then place the apparatus into the case 70 for storage or transport.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. A plunger apparatus comprising:

a collapsible plunger portion having a hollow interior and an opening formed in its bottom end adapted for sealing engagement with a drain opening and an opening formed end its top end adapted for threaded engagement with an elongated handle having a central bore, the elongated handle having a top end and a threaded bottom end, said threaded bottom end engaged with the opening formed in the top end of the plunger portion to allow fluid communication between said central bore and said hollow interior of said plunger portion;

a check valve positioned within said central bore proximate the bottom end of said elongated handle, said check valve oriented to prevent airflow into said bore from said hollow interior;

a cap secured at said top end of said elongated handle, said cap having a sealing member formed therein allowing for selectively allowing airflow through an opening in said top end of said handle;

said sealing member extending from a top interior portion of said cap, said cap further having downwardly extending fingers having thread members formed on interior surfaces for threaded engagement with exterior threads formed in the top end of said elongated handle.

2. The apparatus of claim 1 wherein said thread members formed on said downwardly extending fingers comprise angled protrusions sized in accordance with said exterior threads formed in the top end of said elongated handle.

* * * * *